US012264570B2

(12) United States Patent
Cherry

(10) Patent No.: US 12,264,570 B2
(45) Date of Patent: Apr. 1, 2025

(54) MINERAL RECOVERY

(71) Applicant: Richard Cherry, Norman, OK (US)

(72) Inventor: Richard Cherry, Norman, OK (US)

(73) Assignee: Richard Muriel Cherry, Norman, OK (US)

( * ) Notice: Subject to any disclaimer, the term of this patent is extended or adjusted under 35 U.S.C. 154(b) by 360 days.

(21) Appl. No.: 16/861,732

(22) Filed: Apr. 29, 2020

(65) Prior Publication Data

US 2020/0340346 A1 Oct. 29, 2020

Related U.S. Application Data

(60) Provisional application No. 62/840,034, filed on Apr. 29, 2019.

(51) Int. Cl.

| | |
|---|---|
| ***E21B 43/28*** | (2006.01) |
| ***E21B 7/04*** | (2006.01) |
| ***E21B 43/26*** | (2006.01) |
| ***E21B 49/00*** | (2006.01) |
| ***E21B 49/08*** | (2006.01) |
| *E21B 43/241* | (2006.01) |

(52) U.S. Cl.

CPC ..... *E21B 43/283* (2013.01); *E21B 7/046* (2013.01); *E21B 43/26* (2013.01); *E21B 49/00* (2013.01); *E21B 49/08* (2013.01); *E21B 43/241* (2013.01)

(58) Field of Classification Search

CPC ..... E21B 43/28; E21B 43/283; E21B 7/046; E21B 43/241; E21B 43/26; E21B 43/29; E21B 43/30; E21B 43/305; E21B 49/00; E21B 49/005; E21B 49/02; E21B 49/08; E21B 49/087; E21B 49/0875; E21B 49/088

See application file for complete search history.

(56) References Cited

U.S. PATENT DOCUMENTS 3,708,206 A * 1/1973 Hard ..... E21B 43/28 299/5
3,860,289 A * 1/1975 Learmont ..... E21B 43/28 423/20

(Continued)

FOREIGN PATENT DOCUMENTS

EP 0089294 A1 * 9/1983 ..... C22B 60/0234
GB 2043039 A * 10/1980 ..... C22B 60/0234

*Primary Examiner* — Janine M Kreck
*Assistant Examiner* — Michael A Goodwin
(74) *Attorney, Agent, or Firm* — Silverline Legal, PLLC; Tynia A. McQuigg; Drew T. Palmer

(57) ABSTRACT

Systems and methods for extracting desired minerals from a mineral shale zone located below the surface at an existing oil and gas drilling site using a leaching solution. The system and methods include analyzing a mineral shale zone for one or more desired mineral located at a borehole of the oil and gas wellsite, wherein the borehole was produced with horizontal drilling, and wherein the mineral shale zone includes a plurality of fissures caused by fracking. The systems and methods include pumping the leaching solution into the borehole to mobilize one or more desired materials in the mineral shale zone, extracting from the mineral shale zone the one or more desired minerals, pumping the leaching solution and the desired minerals out of the borehole, and separating the one or more desired minerals from the leaching solution.

19 Claims, 3 Drawing Sheets

(56) References Cited

U.S. PATENT DOCUMENTS

| | | | | |
|---|---|---|---|---|
| 4,221,433 | A | 9/1980 | Jacoby | |
| 4,676,313 | A | 6/1987 | Rinaldi | |
| 5,690,390 | A * | 11/1997 | Bithell | E21B 43/28 299/5 |
| 6,030,048 | A * | 2/2000 | Hsu | C22B 3/02 166/272.2 |
| 7,204,323 | B2 | 4/2007 | Kingsley | |
| 2003/0024700 | A1 | 2/2003 | Cavender | |
| 2004/0108110 | A1 | 6/2004 | Zupanick | |
| 2012/0027516 | A1 | 2/2012 | Day | |
| 2013/0146285 | A1 | 6/2013 | Chhina | |
| 2014/0020954 | A1 | 1/2014 | Pelletier | |
| 2015/0204179 | A1 | 6/2015 | Affholter | |
| 2015/0356403 | A1 | 12/2015 | Storm, Jr. | |
| 2016/0003023 | A1 | 1/2016 | O'Rear | |
| 2016/0032718 | A1 * | 2/2016 | Jones | E21B 49/005 73/152.28 |
| 2016/0123096 | A1 * | 5/2016 | Mathieson | E21C 41/16 175/50 |
| 2016/0356139 | A1 * | 12/2016 | Detournay | E21B 43/283 |
| 2017/0043965 | A1 | 2/2017 | Blaine | |
| 2017/0241266 | A1 * | 8/2017 | Cherry | E21B 43/34 |

* cited by examiner

MINERAL RECOVERY

RELATED APPLICATIONS

This application claims priority from, U.S. Provisional Patent Application Ser. No. 62/840,034 entitled "Mineral Recovery" filed Apr. 29, 2019, the disclosure of which is hereby incorporated by reference.

FIELD OF THE INVENTION

The present invention relates generally to the field of mineral recovery from underground mineral deposits, and more particularly, but not by way of limitation, to a system and method for assessing and producing minerals from horizontal oil and gas wells.

BACKGROUND OF THE INVENTION

Mining for hard rock minerals from underground mining deposits, or shales, has typically been an expensive and laborious process. Past mining methods often required the drilling of hundreds of large sampling wells to assess the size and economic value of an underground mineral deposit. Once a desired mineral deposit was located, traditional mining methods consisted of excavating a large shaft, decline or adit into the mineral deposit to allow access into the underground mineral deposit by personnel and equipment. This type of excavation frequently required large equipment, explosives and additional methods and materials to secure and support the excavation to prevent collapse. In situ mining of minerals has typically required the drilling and completion of multiple large bore injection and production wells in a high porosity mineral deposit. These traditional methods of mining are required for the displacement of large quantities of waste materials and water utilizing several well bores.

There have been hundreds of thousands of oil and gas wells drilled in the United States and even more in other countries. These wells are sometimes drilled to depths of over fifteen thousand feet and are often drilled through regions of rock which could contain significant quantities of minerals that could not be recovered through the traditional rock-mining methods due to the location and depth of the deposits. Further, tens of thousands of horizontal oil and gas wells have been drilled and completed in mineral shales and other unconventional oil and gas deposits, opening an access point for the possible recovery of minerals, other than oil and gas. Hydraulic fracking is often used by oil and gas operators to further open the deposits where they consist of low porosity rock, which allows for increased fluid flows in deposits that contain hard rock minerals. For instance, a typical 5000 foot horizontal lateral drilling bore could have a frac-zone of over 100 feet. This type of drilling and process provides access to millions of tons of shale bearing hard-rock minerals. Nevertheless, these mineral deposits are typically ignored by oil and gas operators, and the hard-rock minerals are passed by and not recovered from the fluids produced from such wells.

Accordingly, there is a need for cost-effective ways to utilize existing or future horizontal oil and gas wells to assess and produce hard-rock minerals located far beneath the surface in areas that traditional mining ignores and that overcomes these other deficiencies in the prior art. It is to these and other objects that the present invention is directed.

SUMMARY OF THE INVENTION

In an embodiment, the present invention includes systems and methods for extracting minerals from a mineral shale zone. The method includes analyzing a mineral shale zone located at the borehole of an existing oil and gas well site for one or more desired minerals. In a preferred embodiment, the borehole was produced via horizontal drilling and the mineral shale zone includes a plurality of fissures caused by fracking. In some embodiments if there is no existing oil and gas site, the method may include drilling one or more horizontal assessment bores and drilling boreholes for production in the mineral shale zone. In addition the method may include fracking the borehole for production to produce fissures. After analyzing the mineral shale zone, if one or more desired minerals are present in the borehole, the method includes pumping a leaching solution into the borehole and fissures. The one or more desired minerals are mobilized by allowing the leaching solution to stay in contact with the borehole and fissures for a set period of time. Once the leaching solution contains the desired amount of one or more minerals, the method includes pumping the leaching solution and the desired one or more minerals out of the borehole. In some embodiments the leaching solution and desired minerals are pumped to a processing lab wherein the amount of desired mineral present may be determined and the desired mineral may be separated from the leaching solution.

DETAILED DESCRIPTION OF THE PREFERRED EMBODIMENTS

Figure 1:
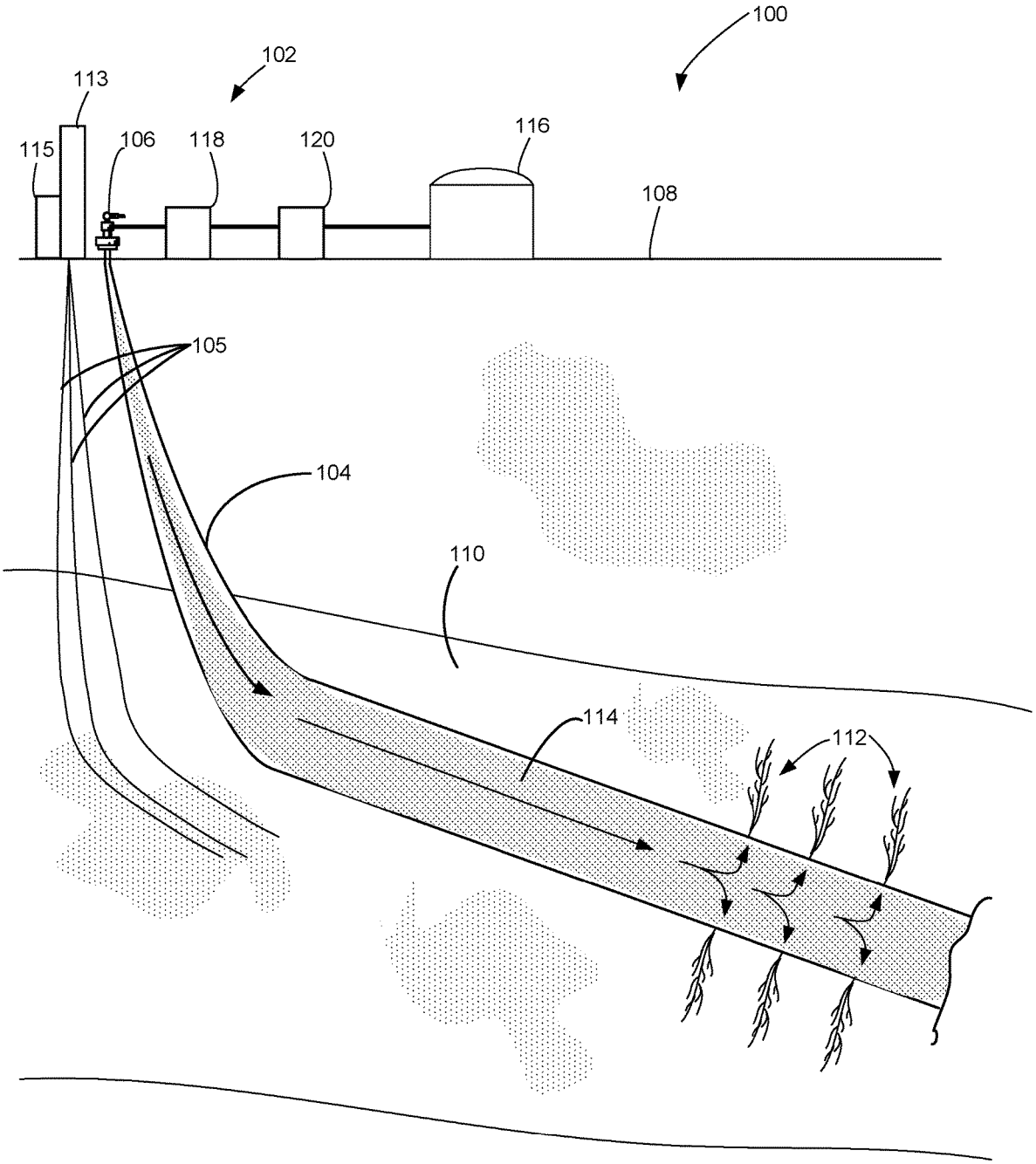
FIG. 1 is a cross-sectional view of a mineral extraction system at an oil and gas well site.

FIG. 1 shows a cross-sectional view of the mineral extraction system 100 installed at an oil and gas well site 102. The mineral extraction system 100 utilizes a borehole 104 drilled at the oil and gas well site 102. While one borehole 104 is depicted, it will be understood that more than one borehole 104 may be utilized in the described system and methods herein. The borehole 104 extends from a wellhead 106 at the surface 108 downward and passes into a mineral shale zone 110. The borehole 104 is drilled utilizing known oil and gas drilling methods, including horizontal drilling methods, such that the borehole 104 is directed horizontally out into the mineral shale zone 110. Since the oil or gas well site 102 may be the only contact with the mineral shale zone 110 for many square miles below the surface 108, the boreholes 104 could extend for miles horizontally from the oil and gas well site 102. The boreholes 104 may extend in multiple radial directions and in multiple horizontal depths to locate the bounds of the mineral shale zone 110. Preferably, hydraulic fracturing "fracking" has been used to cause increased porosity in the mineral shale zone 110 surrounding the borehole 104. This fracking causes a multitude of fissures 112 in the mineral shale zone 110.

It will be understood that existing oil and gas boreholes may be utilized by the system or new boreholes may be drilled for the purpose of extracting minerals using the system and methods described herein. If existing boreholes are used, existing oil and gas well logs and core and cutting samples are analyzed for recoverable minerals and tested to determine if the borehole 104 is located in a desired mineral shale zone 110 and to determine an appropriate leaching solution to use to extract minerals that may be located in that mineral shale zone 110. If existing oil and gas boreholes are not used, then known geological exploration and mapping technology, as well as sampling and testing of the rock from the mineral shale zone 110, may be used to determine a preferred surface location at which to drill and/or frack, as well as the subsurface location where the preferred minerals are located. In some embodiments one or more horizontal assessment bores 105, which are smaller in diameter than a borehole 104 used for production are drilled to acquire a sample for testing.

It will be understood that common hard rock minerals being located in the mineral shale zone 110 may include precious metals, gold, silver, platinum, rare earths, vanadium, molybdenum, cobalt and uranium. These minerals may be economically recovered at relatively low concentrations. Additionally, other minerals containing high concentrations of lesser valuable metals may be economical if the concentration is high enough and refining or processing facilities are near.

The mineral extraction system includes a leaching solution 114, selected based on the testing and analysis performed on rock from the mineral shale zone 110. The samples of rock may be obtained from prior drilling samples or through new coring samples acquired from the well. The leaching solution 114, may be stored at the well site 102 in a storage tank 116, or may be otherwise trucked or piped to the well site 102. The system 100 also includes a pump 118 and may include an oxidizer 120.

It is understood in the industry that normal shale has a lower porosity and permeability than fracked shale. The permeability of the shale is selectively increased after fracking allowing more of the leaching agent 114 to be in contact with the mineral shale zone 110. Within the fractured mineral shale zone 110 there is an increased area of the rock that will be in contact with the leaching agent 114 due to the fissures 112 opened by the frack and the sand added to hold the fissures 112 open. This increases the recovery of minerals within fracked mineral shale zone 110.

Once testing and location have been determined, and an appropriate leaching solution has been selected, the leaching solution 114 is pumped via the pump 118 in a downward direction into the borehole 104. It will be understood that in some cases, the minerals to be extracted, such as uranium, need oxygen added to the leach solution to make the minerals soluble. In these instances, prior to pumping the leaching solution 114 into the borehole, the oxidizer 120 may be used to add oxygen to the leaching solution 114. It will be understood that the oxidizer 120 utilizes a feed pump to feed the oxygen into the pump 118 and into the borehole 104. In some boreholes 104, uranium may be present in the shale in a reduced form and an increased amount of oxidizer may be necessary to effectively leach and extract the reduced uranium. In some embodiments, the leaching solution 114 selected may comprise acid or alkaline solutions with high levels of oxidants such as oxygen. Where the frack fluid present in the borehole 104 has a high level of dissolved solid content ion exchange may be used to promote extraction of desired minerals.

The leaching solutions 114 may comprise solutions which are targeted to specific mineral properties to promote extraction. For instance in some embodiments a dilute sodium bicarbonate solution in a leaching solution 114 may be used to remove easily exchangeable ions from the mineral shale zone 110. In other embodiments a hydrochloric acid may be used in a leaching solution 114 to extract uranium and dissolve carbonate minerals and strongly sorbed metals present in the mineral shale zone 110. Still in other embodiments, hydrogen peroxide may be used in a leaching solution 114 to solubilize minerals such as uranium, zinc, and chromium and to otherwise oxidize organic matter and associated metals present in the mineral shale zone 110. In other embodiments a sodium dithionite solution may be used in the leaching solution 114 to remove oxide and hydroxide minerals and their associated metals from the mineral shale zone 110. In other embodiments, a sodium cyanide leach solution may be used in the leaching solution 114 to extract gold and associated metals present in the mineral shale zone 110.

It will be understood that various leaching solutions 114 and capture methods may be used and tuned to target the recovery of various minerals present in a mineral shale zone 110. As shown by the examples above, leaching solutions 114 can leach heavy metals and other minerals within organic-rich mineral shale zones 110. Recovery factors will vary on an in-situ basis based on factors such as the leaching solution 114, depth, pressure conditions, porosity, permeability, fluid recovery fracking radius, present reagents and other factors present in the mineral shale zone 110 and borehole 104. The total mineral recovery rate will also be function of how much leaching solutions 114 comes in contact with the mineral shale zone 110, how much of the desired mineral present in the mineral shale zone 110 is mobilized into leaching solution 114, and how much of the leaching solution 114 is ultimately recovered to surface.

As the leaching solution 114 is being pumped into the borehole 104, the leaching solution 114 is forced downward into the borehole 104 and out the fissures 112. This allows the leaching solution 114 to be in contact with the minerals located within the mineral shale zone 110. The leaching solution 114 then remains in contact with the mineral shale zone 110 for a period of time to maximize the extraction of minerals from the mineral shale zone into the leaching solution. The length of contact preferably ranges from a few days to weeks, but it will be understood that the time will vary to extract the most minerals from the mineral shale zone 110 and will be based on the test results. While the leaching solution is in contact with the mineral shale zone, testing equipment (not depicted) may be placed into the borehole 104 to analyze the amount of minerals present in the leaching solution 114.

Figure 2:
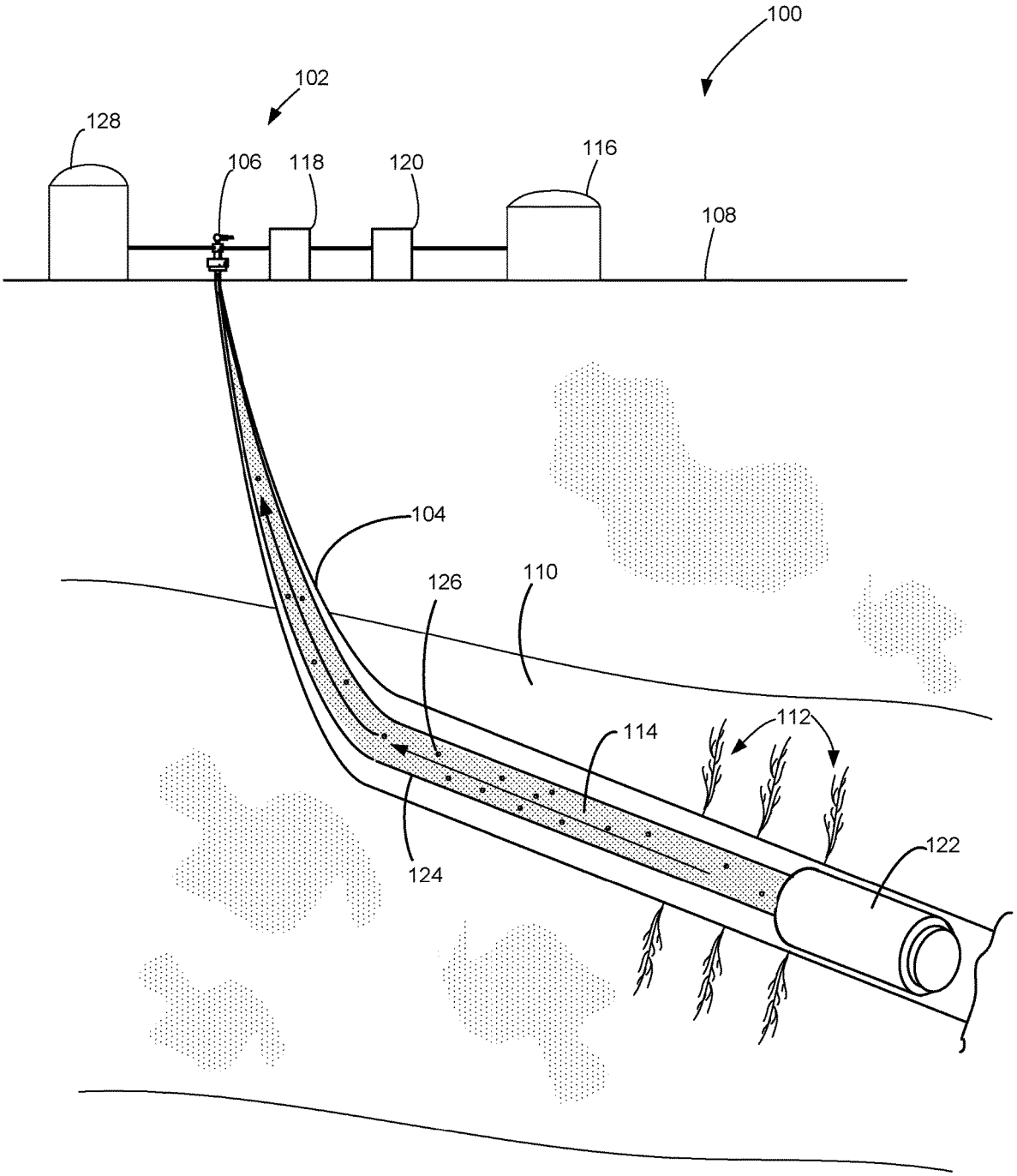
FIG. 2 is a second cross-sectional view of the mineral extraction system of FIG. 1.

As depicted in FIG. 2, after the leaching solution 114 has been in place for sufficient time to extract the minerals, a downhole pump 122 is placed into the borehole 104 attached to downhole tubing 124. The downhole pump 122 is used to pump the leaching solution 114 containing minerals 126 to the surface 108. After reaching the surface, the leaching solution 114 may be processed to extract the minerals 126 in a processing lab 128, or may be transported directly to another facility for mineral recovery. The processing lab 128 may include a separator to separate the desired minerals 126 from the leaching solution and analyze the amount of minerals 126 recovered from the mineral shale zone 110. In some embodiments the amount of desired minerals 126 present in the leaching solution 114 may be determined by the processing lab 128 without separating the minerals 126 from the leaching solution 114. The minerals extracted from the leaching solution may then be further refined into marketable materials. It will be understood that the leaching solution 114 may also need to be processed at the well site 102 to remove any oil and gas that might be contained in the leaching solution prior to processing for minerals or transportation.

It will be understood that the method of drilling at least one horizontal borehole with production boring equipment may be utilized at any desired location where minerals are known or thought to be present. Although the above system is described at an oil and gas site 102, minerals could be obtained from a mineral shale zone located at a traditional mining location where the minerals are already known but previously not obtainable due to the size of the mineral deposits or the depth or structural instability.

Figure 3:
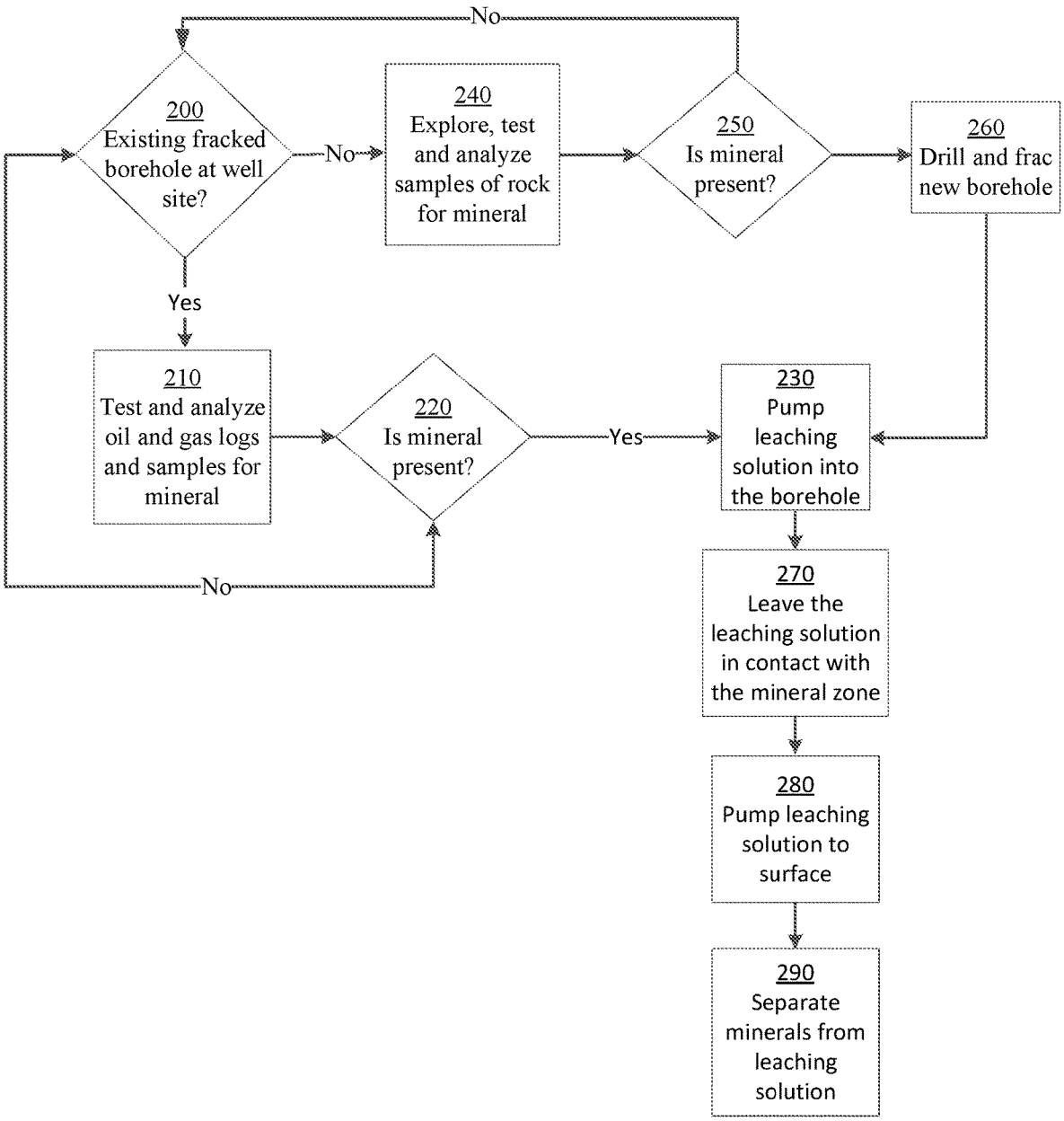
FIG. 3 is a flowchart depicting a mineral extraction method.

Turning now to FIG. 3, depicted therein is a flow chart showing a process of extracting minerals utilizing horizontal drilling methods. In step 200, the process determines whether you are utilizing an existing fracked boresight at an existing well site. If yes, the process moves to step 210 wherein the oil and gas logs and samples are analyzed. In step 220, the process determines whether a desired mineral or group of minerals is present. If the desired mineral is not present, the process returns to step 200. If the desired mineral is present, the process moves to step 230, wherein the process pumps the leaching solution down into the borehole.

Returning to step 200, if the process determines that you are not at an existing fracked borehole, the process moves to step 240 where exploration, testing and sampling of rock from a mineral shale zone is performed. Then, in step 250, the process determines if mineral is present in the mineral shale zone. If there are no minerals present, the process moves back to step 200. If the desired mineral is present, the process moves to step 260 and a new borehole is drilled and fracked using a known horizontal drilling system 113 (see FIG. 1) and known fracking system 115 (see FIG. 1). The process then moves to step 230.

Next, in step 270, the leaching solution that has been pumped down into the borehole will be allowed to stay in contact with the mineral zone, which includes contact with the fissures that are in the rock from fracking. After enough time has passed the minerals will become soluble and will be extracted from the mineral shale zone into the leaching solution. The process then moves to step 280 and the leaching solution with the minerals are pumped to the surface. Then in step 290, the minerals are extracted from the leaching solution, using known separation and recovery methods. The level of desired minerals present in the leaching solution pumped from the borehole may be analyzed to monitor change in the recovery of the desired mineral over time. The leaching of desired minerals from a particular borehole, frack site or mineral shale zone may be stopped based on the change in the level of desired minerals in the leaching solution. The stoppage may be triggered by the desired mineral amount in the leaching solution reaching a lower threshold of desired mineral in the leaching solution such as a profitability threshold. The change in the desired mineral level may be due to a depletion of the desired minerals from the frack site.

The system and method creates a process to assess and recover minerals at depths and in environments that may not have been accessible before by using horizontal and directional drilling techniques and equipment instead of past non-economical mining methods.

It is to be understood that even though numerous characteristics and advantages of various embodiments of the present invention have been set forth in the foregoing description, together with details of the structure and functions of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. It will be appreciated by those skilled in the art that the teachings of the present invention can be applied to other systems without departing from the scope and spirit of the present invention.

It is claimed:

1. A method for extracting one or more desired minerals from an existing oil and gas wellsite, the method comprising:

analyzing a mineral shale zone for the one or more desired minerals, wherein a single borehole that was produced with horizontal drilling at the existing oil and gas wellsite extends from the surface into the mineral shale zone, and wherein the mineral shale zone includes a plurality of fissures caused by fracking, and wherein each of the one or more desired minerals are hard rock minerals;

pumping a leaching solution through the single borehole and directly into the plurality of fissures in the mineral shale zone, wherein the leaching solution mobilizes the one or more desired minerals in the mineral shale zone;

extracting from the mineral shale zone the one or more desired minerals with the leaching solution;

pumping the leaching solution and the one or more desired minerals out of the plurality of fissures in the mineral shale zone, directly into the single borehole, and to the surface;

processing the leaching solution at the oil and gas wellsite to remove oil and gas from the leaching solution; and separating the one or more desired minerals from the leaching solution.

2. The method of claim 1 further comprising analyzing the leaching solution in the borehole to determine the amount of the one or more desired minerals present.

3. The method of claim 2, wherein the one or more desired minerals are extracted by allowing the leaching solution to stay in contact with the mineral shale zone for a period of time associated with the presence of one or more desired minerals in the leaching solution.

4. The method of claim 3, wherein the leaching solution and the one or more desired minerals are pumped to a storage tank.

5. The method of claim 1 further comprising the steps of:

drilling one or more horizontal assessment bores in the mineral shale zone, said one or more horizontal assessment bores having a location; and analyzing a sample material produced from the one or more horizontal assessment bores to determine if a desired mineral is present in the sample material.

6. The method of claim 5, wherein the location of each of the one or more horizontal assessment bores is at a different depth in the mineral shale zone.

7. The method of claim 1 further comprising pumping oxygen into the borehole to increase the amount of the one or more desired minerals extracted from the mineral shale zone.

8. The method of claim 7, wherein one of the one or more desired minerals is uranium.

9. A method for extracting minerals from a mineral shale zone, the method comprising:

analyzing sample material produced from a single borehole to determine if a desired mineral is present in the sample material, wherein the single borehole extends from the surface at an oil and gas well site into the mineral shale zone and comprises a plurality of fissures at the mineral shale zone that were produced from fracking performed on the single borehole, and wherein the desired mineral is a hard rock mineral;

pumping a leaching solution through the single borehole and directly into the plurality of fissures in the mineral shale zone, wherein the leaching solution mobilizes the desired mineral and oil and gas in the mineral shale zone;

extracting from the mineral shale zone into the leaching solution the desired mineral with the leaching solution;

pumping the leaching solution and the desired mineral out of the plurality of fissures in the mineral shale zone, directly into the single borehole, and to the surface;

processing the leaching solution at the oil and gas wellsite to remove the oil and gas from the leaching solution; and separating the desired mineral from the leaching solution.

10. The method of claim 9 further comprising:

analyzing the leaching solution pumped from the borehole to determine the amount of the desired mineral present; and stopping the pumping of the leaching solution out of the borehole when the amount of the desired mineral in the leaching solution reaches a lower threshold.

11. The method of claim 10, wherein the desired mineral is extracted by allowing the leaching solution to stay in contact with the mineral shale zone for a set period of time.

12. The method of claim 11, wherein the leaching solution and desired mineral are pumped to a storage tank.

13. The method of claim 12, wherein the desired mineral is uranium, and the leaching solution comprises an oxidizer.

14. The method of claim 11, wherein the set period of time is at least one week.

15. A system for extracting minerals from a mineral shale zone, the system comprising:

a fracking system configured to frack a single borehole that extends from the surface at an oil and gas well site into the mineral shale zone to produce a plurality of fissures at the mineral shale zone;

a leaching solution, wherein the leaching solution mobilizes one or more desired minerals and oil and gas from the mineral shale zone, wherein each of the one or more desired minerals are hard rock minerals;

a surface pump configured to insert the leaching solution through the single borehole and directly into the plurality of fissures in the mineral shale zone;

a downhole pump configured to pump the leaching solution and the one or more desired minerals out of the plurality of fissures in the mineral shale zone, directly into the single borehole, and to the surface; and a separator configured to process the leaching solution at the oil and gas wellsite to remove the oil and gas from the leaching solution and then separate the one or more desired minerals from the leaching solution.

16. The system of claim 15 further comprising:

a horizontal drilling system configured to drill the single borehole and one or more assessment bores into the mineral shale zone.

17. The system of claim 16 further comprising a processing lab, wherein the processing lab is configured to determine an amount of the one or more desired minerals present in the leaching solution.

18. The system of claim 17, wherein the leaching solution comprises an oxidizer, wherein the oxidizer assists in pumping the one or more desired minerals out of the mineral shale zone.

19. The system of claim 18, wherein one of the one or more desired minerals is uranium.

* * * * *